US007633334B1

(12) United States Patent
Li et al.

(10) Patent No.: US 7,633,334 B1
(45) Date of Patent: Dec. 15, 2009

(54) BANDGAP VOLTAGE REFERENCE CIRCUIT WORKING UNDER WIDE SUPPLY RANGE

(75) Inventors: Ying Tian Li, Singapore (SG); Yayue Zhang, Singapore (SG)

(73) Assignee: Marvell International Ltd., Hamilton (BM)

( * ) Notice: Subject to any disclaimer, the term of this patent is extended or adjusted under 35 U.S.C. 154(b) by 0 days.

(21) Appl. No.: 12/028,609

(22) Filed: Feb. 8, 2008

Related U.S. Application Data

(62) Division of application No. 11/159,503, filed on Jun. 22, 2005, now abandoned.

(60) Provisional application No. 60/648,015, filed on Jan. 28, 2005.

(51) Int. Cl.
*G05F 1/10* (2006.01)

(52) U.S. Cl. ..... 327/539; 323/313

(58) Field of Classification Search ..... 327/539; 323/313

See application file for complete search history.

(56) References Cited

U.S. PATENT DOCUMENTS 5,081,410 A * 1/1992 Wood ..... 323/316
5,512,817 A 4/1996 Nagaraj
5,781,043 A * 7/1998 Slemmer ..... 327/78
5,952,873 A 9/1999 Rincon-Mora
6,771,055 B1 8/2004 Bell
6,998,902 B2 * 2/2006 Sugimura ..... 327/539
7,113,025 B2 9/2006 Washburn
7,199,646 B1 4/2007 Zupcau et al.

OTHER PUBLICATIONS

Behzad Razavi, Design of Analog CMOS Integrated Circuits 377-400 (McGraw-Hill 2001).
Khong-Meng Tham and Krishnaswamy Nagaraj, A Low Supply Voltage High PSRR Voltage Reference in CMOS Process, IEEE Journal of Solid State Circuits, vol. 30, No. 5, May 1995, at 586-590.
R. Jacob Baker et al., CMOS Circuit Design, Layout, and Simulation 276-277 (IEEE Press 1998).

* cited by examiner

*Primary Examiner*—Kenneth B. Wells

(57) ABSTRACT

Bandgap voltage reference circuitry working under a wide supply range is provided. The bandgap reference circuitry in accordance with the invention may provide an accurate reference voltage for systems with a supply voltage that may range from approximately 1.8V to approximately 5.5V. The circuitry may be designed using a standard process and standard devices without requiring the use of special low-threshold devices or deep N-well processes and may generate an internal regulated supply voltage that may remain at a substantially stable voltage level, in spite of variations in the power supply voltage. The bandgap reference circuitry may further use a voltage clamping structure to reduce leakage currents.

21 Claims, 6 Drawing Sheets

BANDGAP VOLTAGE REFERENCE CIRCUIT WORKING UNDER WIDE SUPPLY RANGE

CROSS REFERENCE TO RELATED APPLICATIONS

This application claims the benefit of provisional application 60/648,015 filed Jan. 28, 2005, which is hereby incorporated by reference herein in its entirety.

This is a divisional of commonly-assigned U.S. patent application Ser. No. 11/159,503, filed Jun. 22, 2005, now abandoned, which is hereby incorporated by reference herein in its entirety.

BACKGROUND OF THE INVENTION

This invention relates to bandgap reference circuitry, having a wide supply range, that may generate an accurate and stable voltage reference.

Many precision analog circuits operate with supply voltages that are in the 3V and 5V ranges. This is due in part to the increasing use of battery powered systems and semiconductor voltage specifications. In order to reduce the costs of these systems, the analog circuits need to be designed using standard manufacturing processes and devices.

Accurate and stable voltage reference circuits are required in almost every analog chip. Voltage reference circuits are capable of providing substantially constant reference voltages that are designed to be substantially independent of temperature and process variations.

As is known in the art, a bandgap voltage reference is a circuit having a positive temperature coefficient and a negative temperature coefficient that are combined to have a nominally zero temperature coefficient. A voltage with a negative temperature coefficient is derived from the base-emitter voltage of a bipolar transistor and a voltage with a positive temperature coefficient is derived from the difference between two bipolar transistors operating with different current densities. Summing the voltage with the negative temperature coefficient and the voltage with the positive temperature coefficient, according to a proper ratio, will result in a voltage having substantially zero temperature dependence.

The voltage levels of typical voltage reference circuits must remain within a stable and well-defined range in order to maintain a stable voltage reference output. However, in certain low-power devices, such as hard-disc-driving chips, accurate voltage references are needed both for the power-good mode (e.g., in the 3V or 5v ranges) and for low-power modes (e.g., an emergency-retract mode, in which the supply voltage may be as low as 1.8V).

In view of the foregoing, it would be desirable to provide a bandgap voltage reference circuit that may provide a stable voltage reference output under a wide range of supply voltages.

SUMMARY OF THE INVENTION

These and other objects of the invention are provided by bandgap voltage reference circuitry working under a wide supply range.

A bandgap reference circuit in accordance with the invention may provide an accurate reference voltage for systems having a supply voltage that may, for example, range from approximately 1.8V to approximately 5.5V. The bandgap reference circuit may be designed using a standard process and standard devices and without requiring the use of special low-threshold devices or deep N-well processes.

A bandgap reference circuit in accordance with the invention may generate an internal regulated supply voltage that may remain at a substantially stable voltage level, in spite of variations in the power supply voltage. A high-gain feedback loop may maintain the stability of the internal regulated power supply voltage, while the power supply voltage varies. The high-gain feedback loop may also improve the power supply rejection ratio (PSRR) from the power supply to the internal regulated power supply.

The bandgap reference circuit, in accordance with the invention, may further increase the accuracy of the voltage reference at high supply voltages by using a clamping structure to reduce leakage currents.

Further features of the invention, its nature and various advantages, will be more apparent from the accompanying drawings and the following detailed description of the preferred embodiments.

DETAILED DESCRIPTION

Figure 1:
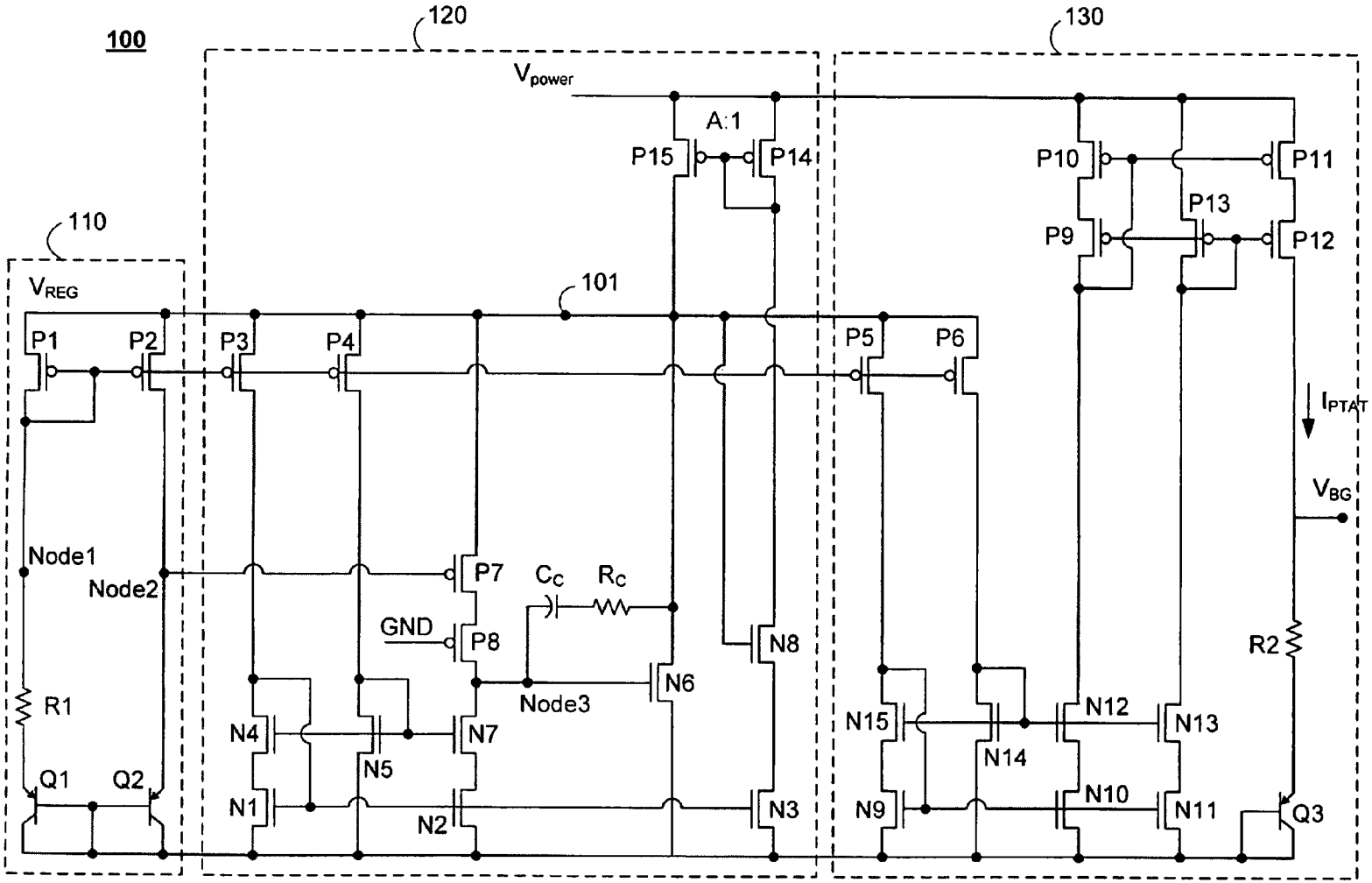
FIG. 1 shows a simplified diagram of a bandgap voltage reference circuit in accordance with some aspects of the present invention.

FIG. 1 shows bandgap voltage reference circuit 100 in accordance with some aspects of the present invention. Bandgap reference circuit 100 generates bandgap reference voltage $V_{BG}$ from power supply voltage $V_{power}$ using standard processes and devices. $V_{power}$ may, for example, range from a low voltage level of approximately 1.8V to a high voltage level of approximately 5.5V. Bandgap reference voltage $V_{BG}$ preferably remains at a substantially stable voltage level during temperature variations of bandgap voltage reference circuit 100, as well as during variations of the supply voltage $V_{power}$.

Bandgap voltage reference circuit may primarily consist of three components, PTAT current generation circuitry 110, regulated voltage generation circuitry and feedback loop 120, and bandgap reference voltage output circuitry 130. The operation of bandgap reference circuit 100, its underlying components and their interrelation is explained in greater detail below.

In bandgap reference circuit 100, transistors P1, P2, P3, P4, P5, P6, and P7 all have the same W/L ratios. Transistors N1, N2, and N3 are also designed to have the same W/L ratios. The W/L ratios of transistors P15 and P14 are designed such that the W/L ratio of P15 is a multiple, A, times the W/L ratio of P14. Other W/L ratios may be used according to other embodiments of the present invention. However using the same W/L ratios may simplify the explanation and analysis of the circuit.

Transistors P1, P2, Q1, and Q2 and resistor R1, of PTAT current generation circuitry 110, are configured to generate reference current $I_{PTAT}$. As long as Node1 and Node2 remain at substantially equal voltages, reference current $I_{PTAT}$ is said to be proportional to absolute temperature (PTAT), i.e., $I_{PTAT}$ is proportional to the temperature of bandgap reference circuit 100. $I_{PTAT}$ has a positive temperature coefficient and thus the current increases with increased temperature.

Transistor P7 of regulated voltage generation circuitry and feedback loop 120 may help maintain the equality condition of Node1 and Node2. The reference current passing through transistor P1 is mirrored through transistor P7 by transistors N2 and N7. With substantially equal currents passing through transistors P1 and P7, the gate-source voltage drop of P1 is substantially equal to the gate-source voltage drop of P7. Thus, connecting the gate of transistor P7 to Node2 maintains Node2 at a voltage level substantially equal to the voltage level of Node1 (i.e, approximately one gate-source voltage drop below $V_{REG}$).

Although multiple current mirror pairs are used in bandgap reference circuit 100 to transfer reference current $I_{PTAT}$ from PTAT current generation circuitry 110 to regulated voltage generation circuitry and feedback loop 120 and to bandgap reference voltage output circuitry 130, this is just one embodiment of the present invention. Other current mirror configurations or current mirror alternatives may be also used in accordance with the present invention.

PTAT current $I_{PTAT}$ may be calculated from the equation, $$I_{PTAT} = \frac{\Delta V_{BE}}{R1} = V_T \ln N$$

where $\Delta V_{BE}$ is the difference in the base-emitter voltages of transistors Q1 and Q2, $V_T$ is the thermal voltage constant, and N is the ratio of the emitter areas of Q1 and Q2.

Current mirrors in bandgap voltage reference circuit 100 mirror the PTAT current generated by transistors P1, P2, Q1, and Q2 through transistors P3-P6, N1-N3, N9-N11, P10-P11 and Q3. Accordingly, the voltage level at the output of bandgap reference circuit 100 may be expressed as, $$V_{BG} = V_{BE3} + I_{PTAT} \times R2 = V_{BE3} + \frac{\Delta V_{BE}}{R1} \times R2 = V_{BE3} + V_T \frac{R2}{R1} \ln N$$

where $V_{BE3}$ is the base-emitter voltage of transistor Q3.

Bandgap reference voltage $V_{BG}$ may be substantially independent of the temperature of bandgap voltage reference circuit 100. As seen from the above equation, bandgap reference voltage $V_{BG}$ is equal to the sum of $V_{BE3}$ and $I_{PTAT}$ multiplied by resistor R2. $V_{BE3}$ has a negative temperature coefficient (i.e., the value of $V_{BE3}$ decreases as temperature increases) and $I_{PTAT}$ has a positive temperature coefficient (i.e., the value of $I_{PTAT}$ increases as temperature increases). Selecting suitable sizes for R1, R2, and N may allow the temperature coefficients of each of the terms in the equation for the bandgap reference voltage to substantially cancel each other out. Thus, the temperature coefficient of the bandgap reference voltage may be designed to be substantially equal to zero at 25° C.

Component 120 of bandgap reference circuit 100 may generate an internal regulated supply voltage, $V_{REG}$ and may have a feedback loop to maintain the voltage level of $V_{REG}$. Internal regulated supply voltage, $V_{REG}$, is generated in bandgap voltage reference circuit 100 to allow the circuit to operate with a low supply voltage. The DC voltage level of $V_{REG}$ is approximately equal to the base-emitter voltage of transistor Q2 plus the gate-source voltage of transistor P7. Thus $V_{REG}$ can be expressed as, $$V_{REG} = V_{BE2} + V_{GS_P7}.$$

The minimum supply voltage $V_{power}$ can thus be expressed as, $$V_{power} = V_{REG} + V_{ds_P15} = V_{BE2} + V_{GS_P7} + V_{DS_P15}$$

where $V_{DS_P15}$ is the drain-source voltage of P15. Estimating the minimum operating values of each of the terms in the equation for $V_{power}$, the minimum operating value of $V_{power}$ may be approximated to be approximately 1.8V with $V_{REG}$ estimated to be approximately 1.5V.

Common-source configured transistor N6 is connected to Node3. Neglecting N6 as well as $C_c$ and $R_c$, Node3 is a high impedance node that does not have a well defined DC voltage level. By adding NMOS transistor N6 having a gate that is connected to Node3 and source that is connected to ground, the DC voltage level of Node3 may be set by the gate-to-source voltage of N6. Transistor N6 may also maintain the voltage of $V_{REG}$ as part of a negative feedback loop that maintains the substantial equality of Node1 and Node2. For example, when the voltage level of $V_{REG}$ rises, the voltage level of Node1 may also rise, due to the diode-connected PMOS transistor P1. However, the voltage level of Node2 may not change significantly due to the large channel resistance of PMOS transistor P2. Further, the drain currents of PMOS transistor P1 and of NMOS transistors N2 and N7 may also not change significantly in response to the rise of $V_{REG}$. In contrast, the gate-to-source voltage of PMOS transistor P7 may change in accord with the change in the voltage level $V_{REG}$. This change in the gate-to-source voltage of P6 may increase the drain current of P7 which may increase the voltage level of Node3. The increase in the voltage level of Node3 may then increase the current flowing through transistor N6, which may the reduce the voltage level of $V_{REG}$. The high impedance of Node3 enhances the loop-gain of this negative feedback loop. The high loop-gain of the feedback loop also improves the power supply rejection ratio (PSRR) from the power supply voltage $V_{power}$ to the regulated supply voltage $V_{REG}$. In turn, this PSRR reduction reduces the power supply noise on the bandgap reference voltage $V_{BG}$. Miller compensation capacitor $C_C$ and resistor $R_C$ are included in the feedback loop to improve the stability of the loop.

Figure 2:
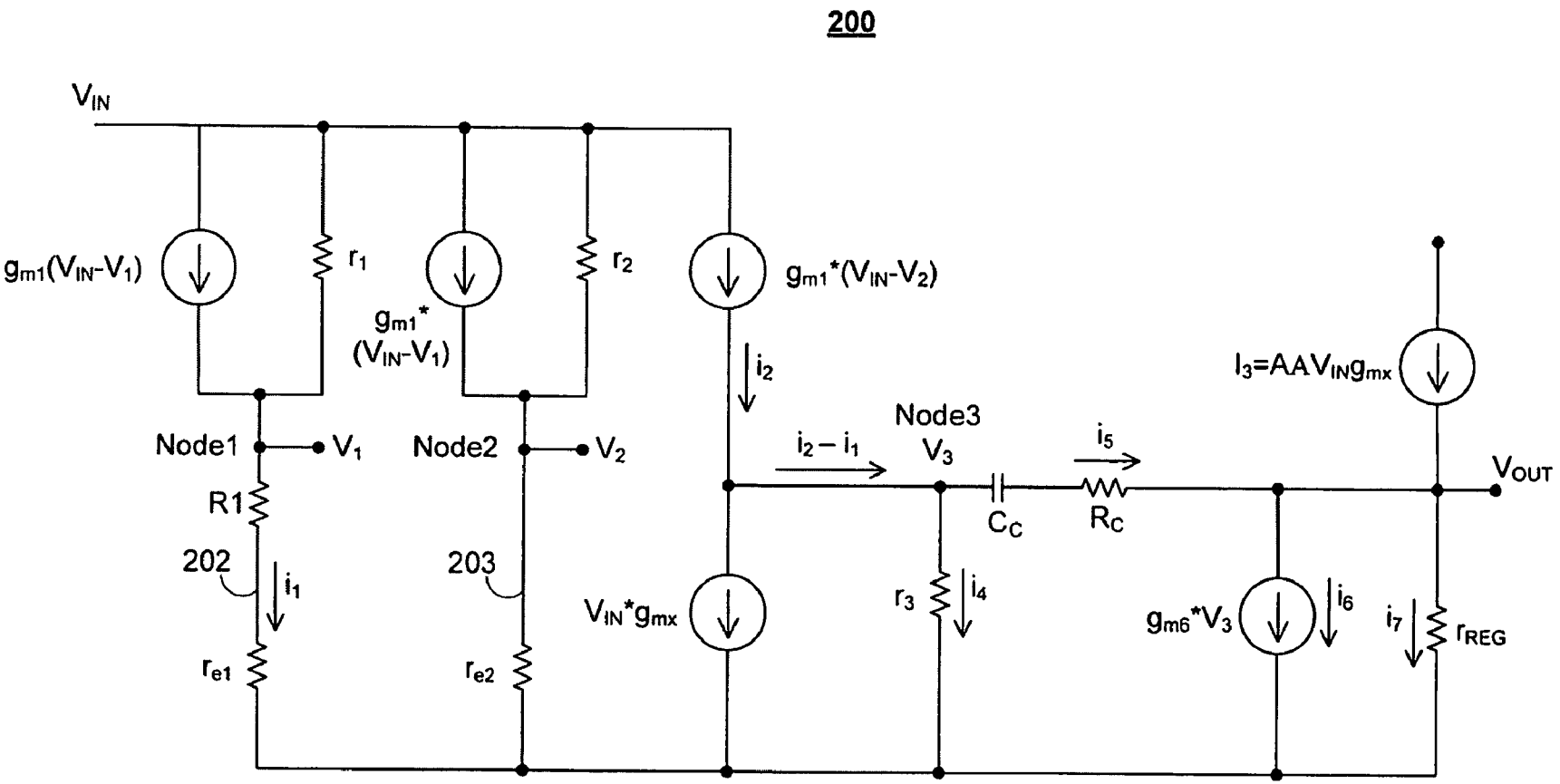
FIG. 2 shows a simplified small-signal circuit model of the bandgap voltage reference circuit in accordance with some aspects of the present invention.

The stability of the feedback loop of bandgap reference circuit 100 may be estimated by breaking the feedback loop at node 101 and performing a small signal analysis. FIG. 2 shows a simplified small signal circuit model 200 of bandgap voltage reference circuit 100 without any parasitic capacitance. Circuit model 200 may be used to show the operation of the feedback loop of bandgap voltage reference circuit 100 in greater detail. Voltage input, $V_{IN}$ represents the voltage variations at the regulated supply $V_{REG}$. Neglecting the high frequency parasitic poles of the current mirrors and the pole at $V_{REG}$ due to the pole splitting due to the Miller compensation, the current flowing through branches 202 and 203 can be written as follows:

$$(V_{IN}-V_1)\times g_{m1}+\frac{V_{IN}-V_1}{r_1}=\frac{V_1}{R1+r_{e1}} \quad (1)$$

$$(V_{IN}-V_1)\times g_{m1}+\frac{V_{IN}-V_2}{r_2}=\frac{V_2}{r_{e2}} \quad (2)$$

where $g_{m1}$ is the transconductance of transistors P1 through P7, $r_{e1}$ is the emitter resistance of transistor Q1, $r_{e2}$ is the emitter resistance of transistor Q2, $r_1$ is the output impedance of transistor P1, and $r_2$ is the output impedance of transistor P2. Solving equations (1) and (2) for $V_1$ and $V_2$, assuming $r_1 >> 1/g_{m1}$ and $r_2 >> r_{e1}$ results in $$V_1=\frac{V_{IN}(R1+r_{e1})}{1/g_{m1}+R1+r_{e1}} \text{ and } V_2=V_{IN}\times\left(1-\frac{R1+r_{e1}}{1/g_{m1}+R1+r_{e1}}\right)g_{m1}r_{e1}.$$

The currents through branches 202 and 203, $i_1$ and $i_2$, are generated by $V_{IN}$ $V_{IN}$ represents the variation in the voltage of regulated power supply $V_{REG}$. Currents $i_1$ and $i_2$ can be expressed as $$i_1=\frac{V_1}{R1+r_{e1}} \text{ and } i_2=g_{m1}(V_{in}-V_2).$$

Substituting for $V_1$ and $V_2$ in the above equation, $$i_1=\frac{V_{IN}}{1/g_{m1}+R1+r_{e1}}=V_{IN}g_{mx}, \text{ where } g_{mx}=\frac{1}{1/g_{m1}+R1+r_{e1}}$$

$$i_2=V_{IN}g_{m1}\left[1-\left(1-\frac{R1+r_{e1}}{1/g_{m1}+R1+r_{e1}}\right)g_{m1}r_{e2}\right]=$$

$$V_{IN}g_{m1}\{1-[1-(R1+r_{e1})g_{mx}]g_{m1}r_{e2}\}=V_{IN}g_{m1}B$$

where $B=1-[1-(R1+r_{e1})g_{mx}]g_{m1}r_{e2}$.

Variation current $i_1$ is mirrored through transistor P15 of bandgap voltage reference circuit 100, which is represented in small signal circuit model 200 by current $i_3$. Assuming a W/L ratio between P15 and P14 of approximately A to 1, current $i_3$ may be expressed as $$i_3=Ai_1=AV_{IN}g_{mx}$$

Applying KCL at node3

$$i_2-i_1=i_4+i_5$$

which may also be written as $$V_{IN}(g_{m1}B-g_{mx})=\frac{V_3}{r_3}+\frac{V_3-V_{OUT}}{R_c+1/C_cS} \quad (3)$$

where $r_3$ is the impedance seen at node3.

Applying KCL at $V_{OUT}$ $$i_6+i_7=i_3+i_5$$

which may also be written as $$V_3g_{m6}+\frac{V_{out}}{r_{reg}}=\frac{V_3-V_{out}}{R_c-1/C_cS}+V_{in}g_{mx}A \quad (4)$$

where $r_{REG}$ is the impedance seen at $V_{OUT}$ and $g_{m6}$ is the transconductance of transistor N6.

From equations (3) and (4), the transfer function of the feedback loop can be written as $$\frac{V_{out}}{V_{in}}(S)=-g_{my}r_3g_{m6}r_{reg}\frac{\left[R_c-\frac{1}{g_{m6}}(1+Ag_{mx}/g_{my})\right]C_cS+1}{g_{m6}r_{reg}C_cS+1}$$

where $g_{my}=g_{m1}B-g_{mx}$.

From this transfer function, it can be seen that the DC loop gain of the feedback loop is $g_{my}r_3\,g_{m6}r_{REG}$. The feedback loop has a dominant pole at $1/g_{m6}r_{REG}r_3C_c$ due to Miller compensation. Further, if the value of $R_C$ is less than $$\frac{1}{g_{m6}}(1+Ag_{mx}/g_{my}),$$

there is a zero in the right-hand plane with a frequency close to the unity-gain bandwidth of the system. This zero may affect the stability of the system.

Figure 3:
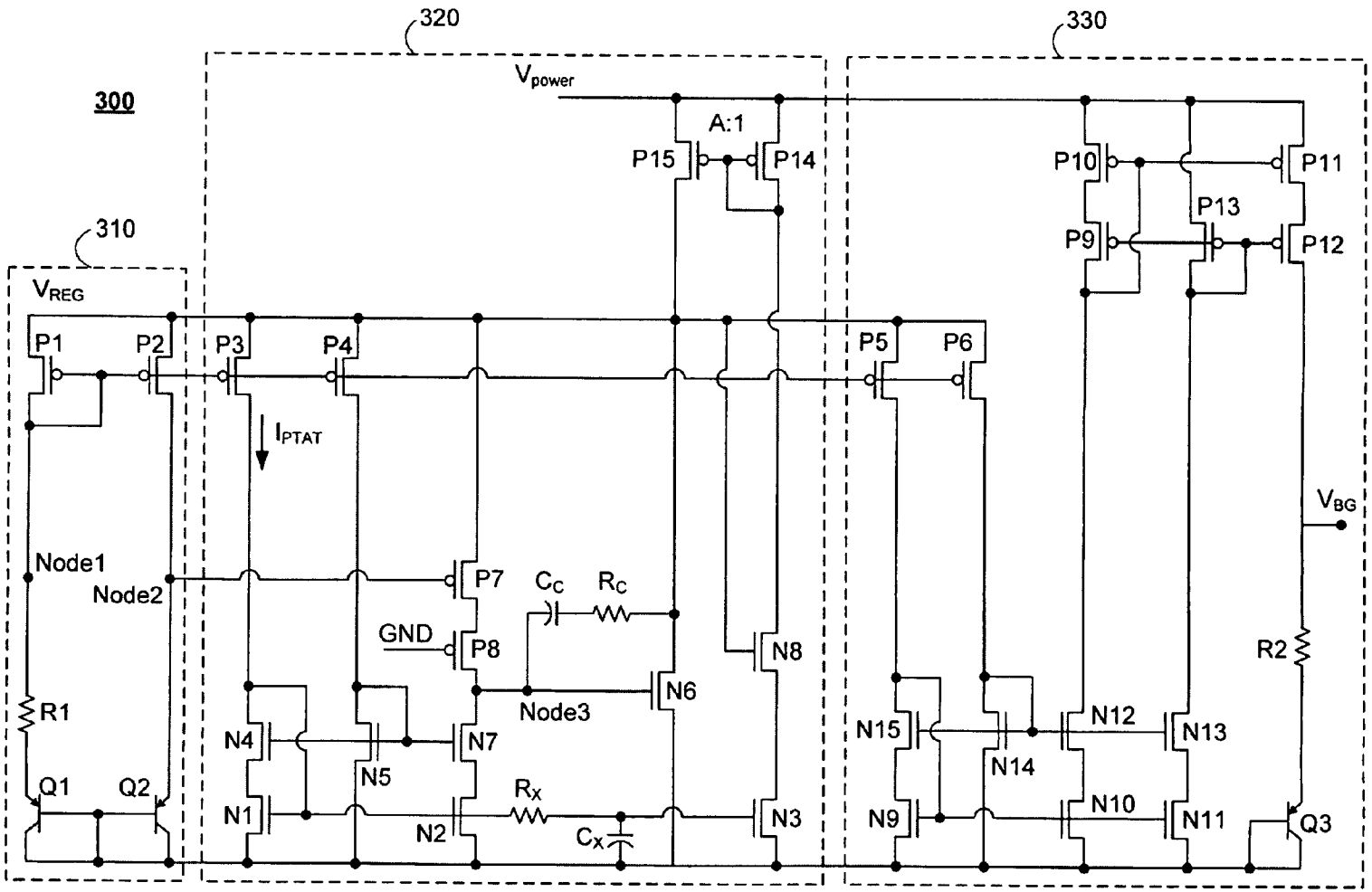
FIG. 3 shows a simplified diagram of a bandgap voltage reference circuit with a low-pass filter in accordance with some aspects of the present invention.
Figure 4:
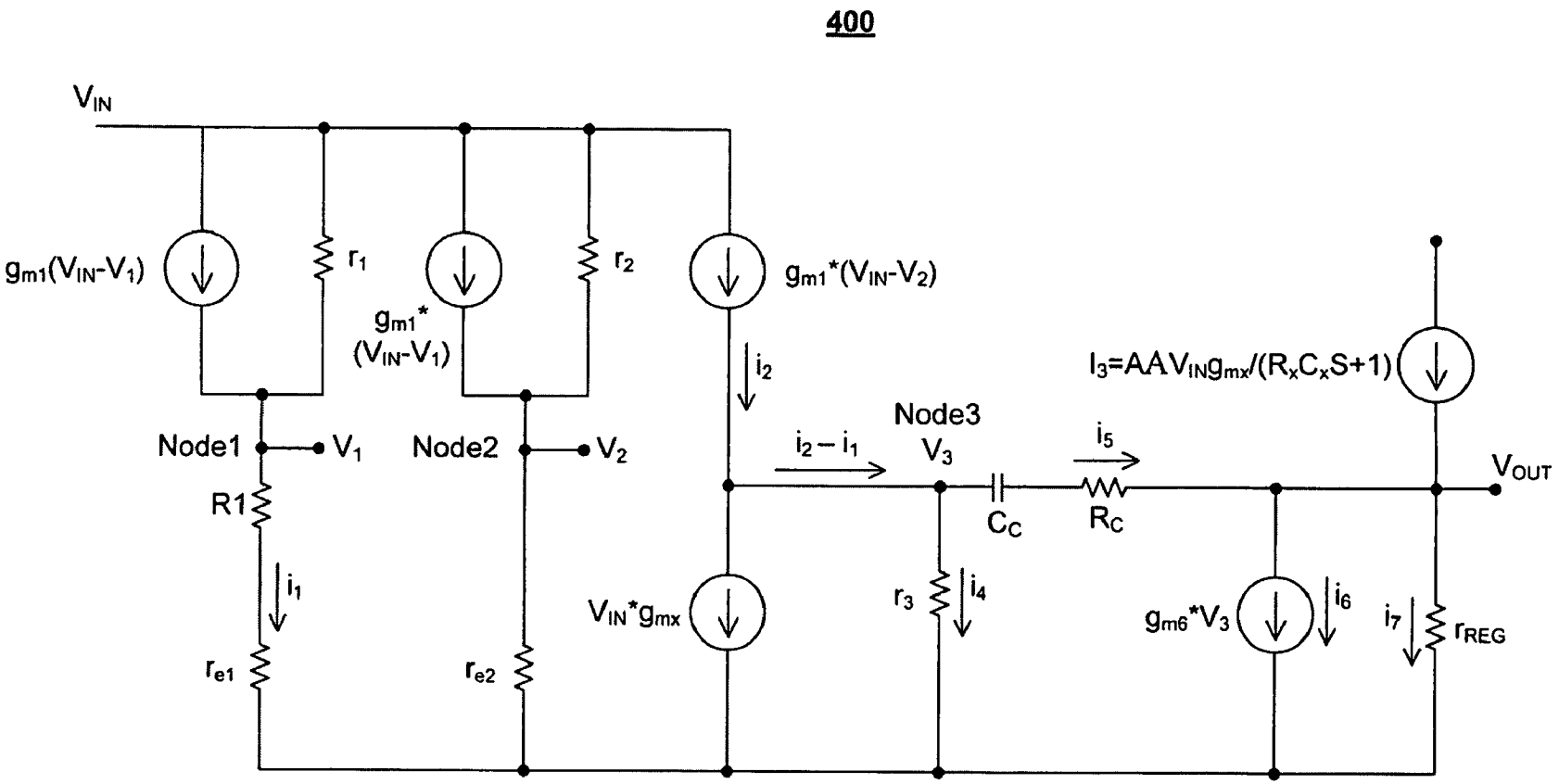
FIG. 4 shows a simplified small-signal circuit model of the bandgap voltage reference circuit with a low-pass filter in accordance with some aspects of the present invention.

FIG. 3 shows bandgap voltage reference circuit 300 in accordance with another embodiment of the present invention which may be able to prevent this zero in the right-hand plane. Bandgap voltage reference circuit 300 includes a low-pass filter including resistor $R_x$ and capacitor $C_x$. FIG. 4 shows a simplified small signal circuit model 400 of bandgap voltage reference circuit 300. With the addition of the low pass filter, node equations (3) and (4) of a simplified small signal circuit model 200 may be rewritten as, $$V_{IN}(g_{m1}B-g_{mx})=\frac{V_3}{r_3}+\frac{V_3-V_{OUT}}{R_c+1/C_cS} \quad (3')$$

$$V_3g_{m6}+\frac{V_{OUT}}{r_{REG}}=\frac{V_3-V_{OUT}}{R_c+1/C_cS}+\frac{V_{IN}g_{mx}A}{R_xC_xS+1} \quad (4')$$

If the value of $R_xC_x$ is made much larger than the other node time constants of the circuit, the new transfer function may be expressed as $$\frac{V_{OUT}}{V_{IN}}(S)=-g_{my}r_3g_{m6}r_{reg}\frac{(R_xC_xS+1)\times[(R_c-1/g_{m6})C_cS+1]}{(R_xC_xS+1)\times(g_{m6}r_{reg}r_3C_cS+1)}=$$

$$-g_{my}r_3g_{m6}r_{reg}\frac{(R_c-1/g_{m6})C_cS+1}{g_{m6}r_{reg}r_3C_cS+1}$$

The dominant poles remains at $1/(g_{m6}r_{reg}r_3C_c)$, but the zero is moved to $1/(R_c-1/g_{m6})C_c$. This zero may be placed in the left-hand plane by making the value of $R_C$ greater than $1/g_{m6}$, which is practical. Accordingly, the low pass filter of bandgap voltage reference circuit 300 may not have the stability problem of bandgap voltage reference circuit 100.

As previously described with respect to bandgap voltage reference circuit 100, the PTAT current is generated by transistors P1, P2, Q1, and Q2 and resistor R1. The PTAT current is mirrored into bandgap reference voltage output circuitry 130 where it passes through resistor R2 and transistor Q3 to generate the bandgap reference voltage output $V_{BG}$. Transistors P1, P2, Q1, and Q2 of PTAT current generation circuitry 310 are all powered by regulated voltage supply $V_{REG}$. Bandgap reference voltage output circuitry 330, however, may need a higher voltage power supply. For example, the minimum power supply voltage needed to keep PMOS transistors P11 and P12 operating in the saturation region is approximately equal to $V_{BG}+V_{Dsat(P11)}+V_{Dsat(P12)}$, which may be around 1.7V. As $V_{REG}$ is only around 1.5V, there is a headroom problem. Accordingly, transistors P9 through P13 of bandgap reference voltage output circuitry 330 are all directly powered from power supply voltage $V_{power}$ instead of regulated voltage supply $V_{REG}$.

Figure 5:
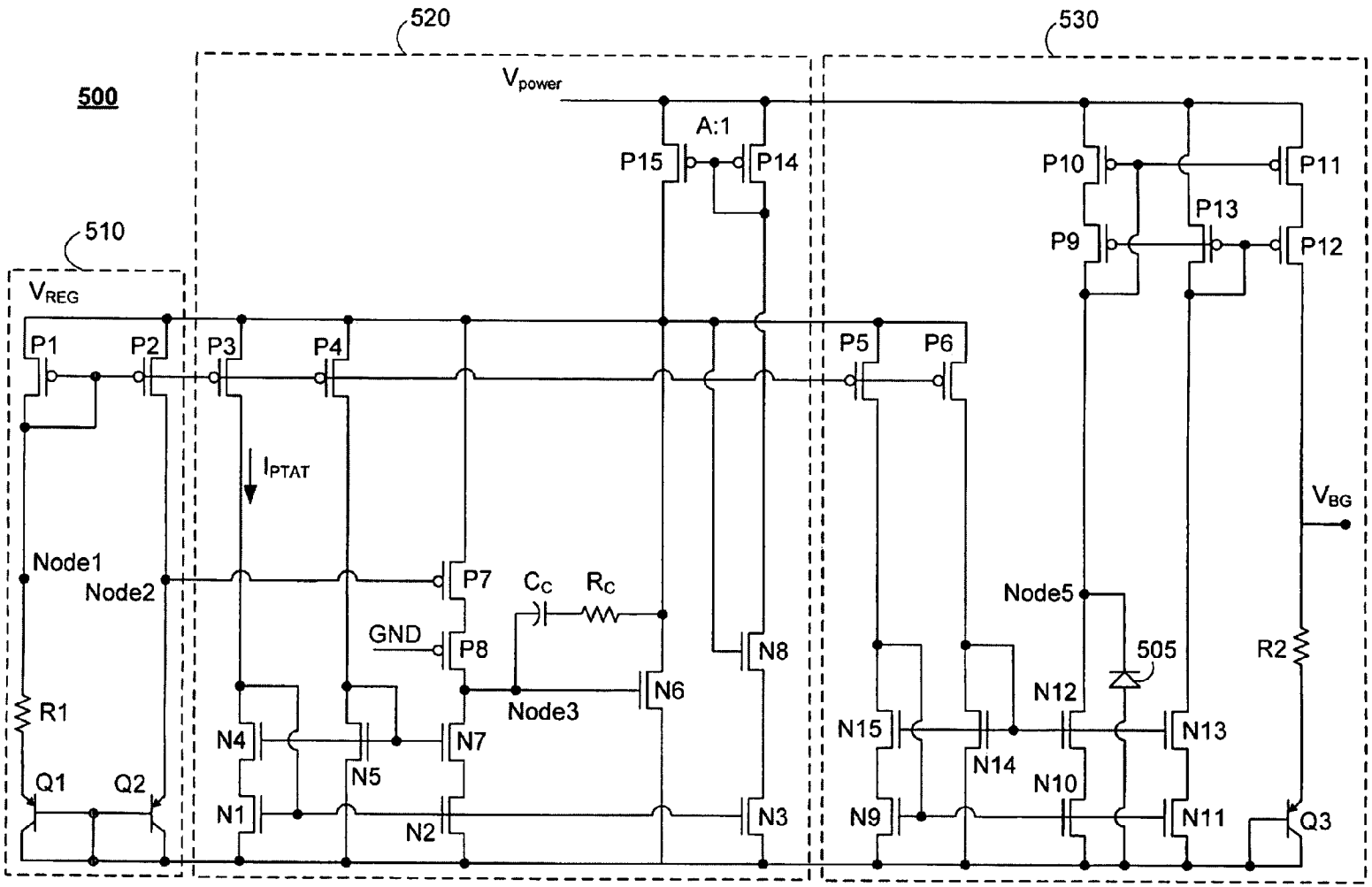
FIG. 5 shows a simplified diagram of a bandgap voltage reference circuit illustrating leakage currents in accordance with some aspects of the present invention.

When $V_{power}$ is at a relatively high voltage level (e.g., above 5V), a leakage current through transistor N12 may cause a rise in bandgap voltage reference output $V_{BG}$. FIG. 5 shows bandgap voltage reference circuit 500 which may illustrate this leakage current. Bandgap voltage reference circuit 500 includes reverse-biased body diode 505 that is connected between node5 and ground. Reverse-biased body diode 505 is a parasitic diode of transistor N12. Because the bandgap reference circuit is fabricated without using a deep-Nwell process, the substrate of transistor N12 is not connected to ground. As a result, there is a reverse-biased body diode between the drain of N12 to ground, which may be modeled by diode 505.

The voltage level of Node5 is one gate-source voltage drop below the power supply voltage $V_{power}$. When bandgap voltage reference circuit 500 is operating with a power supply voltage of around 5V or greater, Node5 is also at a relatively high voltage. As such, the reverse-biased voltage of diode 505 is also high, which may result in a high leakage current through diode 505. The leakage current through diode 505 may be expressed as $$I_{leakage}=I_s(e^{-V5/nV_T}-1)$$

where V5 is the voltage at Node5 and $I_s$ represents the scale current of the device, given by $$I_s=AD*JS$$

where JS is the source-drain junction current density and AD is the area of the source and drain.

When bandgap voltage reference circuit 500 operates with a power supply voltage $V_{power}$ at a voltage level of approximately 5V or greater, the leakage current through diode 505 may be large enough to create an error current that is mirrored to transistor P11. This error current may increase the current flowing through transistor P11 and may thus introduce a non-linear error to bandgap reference voltage output $V_{BG}$. The higher the voltage of the power supply voltage, the higher the error in $V_{BG}$.

Figure 6:
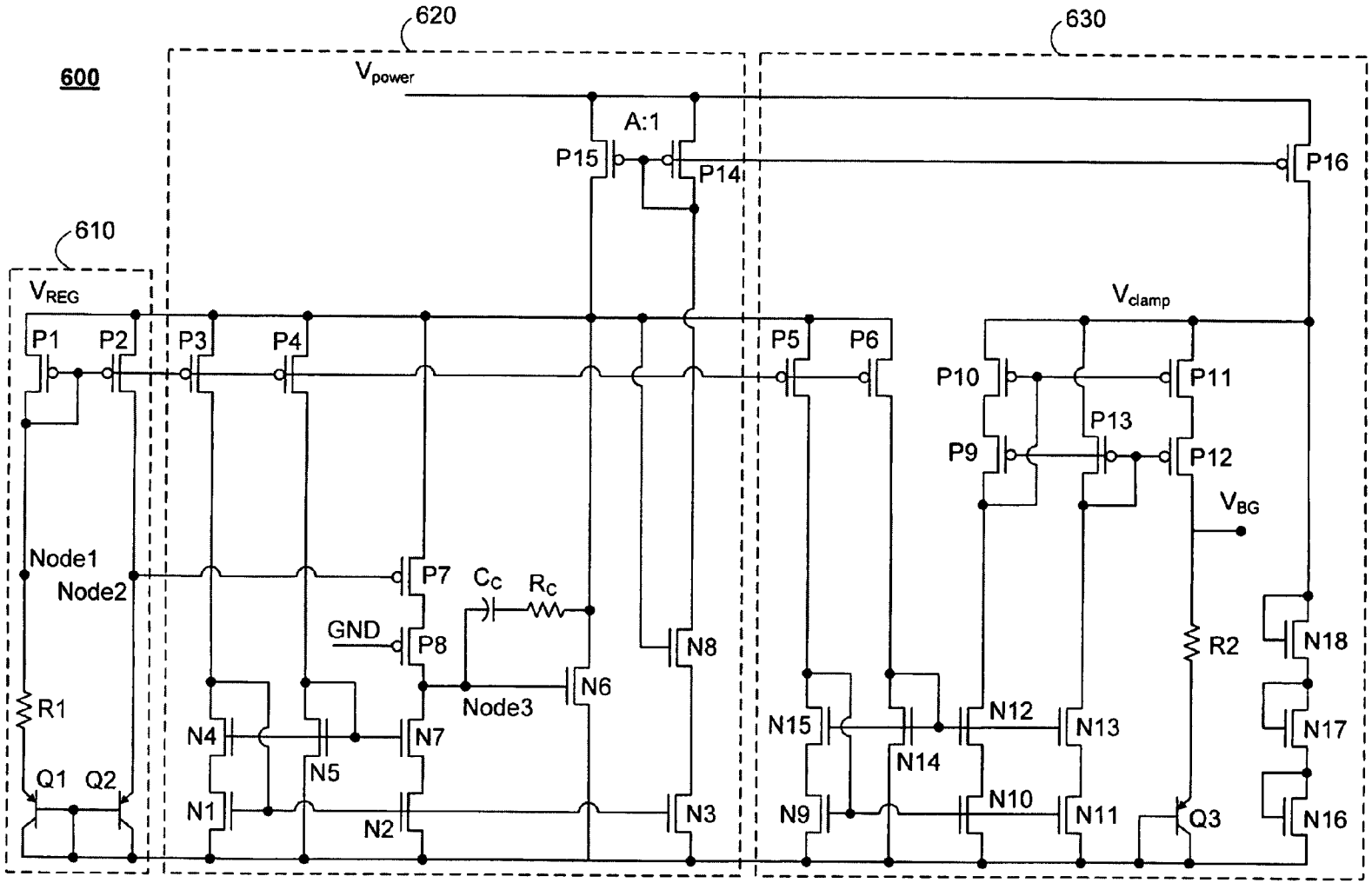
FIG. 6 shows a simplified diagram of a bandgap voltage reference circuit having a clamping structure in accordance with some aspects of the present invention.

FIG. 6 shows bandgap voltage reference circuit 600 in accordance with this invention which may reduce this leakage current. Bandgap voltage reference circuit 600 contains additional transistors N16 through N18 and transistor P16 which may generate a clamping voltage $V_{CLAMP}$. Clamping voltage $V_{CLAMP}$ powers transistors N10 through N13, transistors P9 through P13, transistor Q3, as well as resistor R2. Clamping voltage $V_{CLAMP}$ varies only slightly with variations in power supply voltage $V_{power}$ and maintains a voltage of around 3v. With a voltage of around 3V, only a negligible error is caused by a leakage current through transistor N12. Accordingly, bandgap voltage reference circuit 600 may generate a more accurate bandgap reference voltage $V_{BG}$. Further, the PSRR of bandgap voltage reference circuit 600 remains high due to the high output impedance of transistor P16 and the cascode structure of transistors P11 and P12.

Thus it is seen that bandgap voltage reference circuitry working under a wide supply range, has been provided. It will be understood that the foregoing is only illustrative of the principles of the invention, and that the invention can be practiced by other than the described embodiments, which are presented for purposes of illustration and not of limitation, and the present invention is limited only by the claims which follow.

What is claimed is:

1. A method for generating a bandgap reference voltage from an input power supply voltage having a wide voltage range, said method comprising:

generating a regulated power supply voltage from the input power supply voltage;

maintaining the regulated power supply voltage at a substantially constant voltage level relative to the input power supply voltage;

generating a proportional to absolute temperature ("PTAT") current in a first resistor using PTAT current generation circuitry comprising a first diode-connected transistor having a first voltage drop and a second diode-connected transistor having a second voltage drop, wherein the PTAT current is proportional to a difference between the first and second voltage drops, and wherein the first and second diode-connected transistors are powered by the regulated power supply voltage;

generating a clamping voltage from the input power supply voltage that is greater than the regulated power supply voltage and less than the input power supply voltage;

maintaining the clamping voltage at a substantially constant voltage level relative to the input power supply voltage; and generating the bandgap reference voltage using bandgap reference voltage generation circuitry comprising a third diode-connected transistor and a second resistor that are powered by the clamping voltage, wherein the bandgap reference voltage is generated using the PTAT current to produce a voltage across the second resistor proportional to a ratio between the first resistor and the second resistor.

2. The method of claim 1 wherein the input power supply voltage ranges from approximately 1.8 volts to approximately 5.5 volts.

3. The method of claim 2 wherein the bandgap reference voltage is generated at a substantially stable voltage level throughout the range of the input power supply voltage.

4. The method of claim 1 wherein the regulated power supply voltage is approximately 1.2 volts.

5. The method of claim 1 wherein the clamping voltage is approximately 3 volts.

6. The method of claim 5 wherein the clamping voltage level is substantially stable throughout the range of the input power supply voltage.

7. The method of claim 1 wherein a negative feedback loop maintains the regulated power supply voltage at a substantially constant voltage level relative to the input power supply voltage, and wherein the negative feedback loop maintains the PTAT current proportional to temperature.

8. An apparatus for generating a bandgap reference voltage from an input power supply voltage having a wide voltage range, said apparatus comprising:

means for generating a regulated power supply voltage from the input power supply voltage;

means for maintaining the regulated power supply voltage at a substantially constant voltage level relative to the input power supply voltage;

means for generating a proportional to absolute temperature ("PTAT") current in a first resistor using PTAT current generation circuitry comprising a first diode-connected transistor having a first voltage drop and a second diode-connected transistor having a second voltage drop, wherein the PTAT current is proportional to a difference between the first and second voltage drops, and wherein the first and second diode-connected transistors are powered by the regulated power supply voltage;

means for generating a clamping voltage from the input power supply voltage that is greater than the regulated power supply voltage and less than the input power supply voltage;

means for maintaining the clamping voltage at a substantially constant voltage level relative to the input power supply voltage; and means for generating the bandgap reference voltage using bandgap reference voltage generation circuitry comprising a third diode-connected transistor and a second resistor that are powered by the clamping voltage, wherein the bandgap reference voltage is generated using the PTAT current to produce a voltage across the second resistor proportional to a ratio between the first resistor and the second resistor.

9. The apparatus of claim 8 wherein the input power supply voltage ranges from approximately 1.8 volts to approximately 5.5 volts.

10. The apparatus of claim 9 wherein the bandgap reference voltage is generated at a substantially stable voltage level throughout the range of the input power supply voltage.

11. The apparatus of claim 8 wherein the regulated power supply voltage is approximately 1.2 volts.

12. The apparatus of claim 8 wherein the clamping voltage is approximately 3 volts.

13. The apparatus of claim 12 wherein the clamping voltage level is substantially stable throughout the range of the input power supply voltage.

14. The apparatus of claim 8 further comprising negative feedback means that maintain the regulated power supply voltage at a substantially constant voltage level relative to the input power supply voltage, wherein the negative feedback means maintain the PTAT current proportional to temperature.

15. A bandgap voltage reference circuit with an input power supply voltage having a wide voltage range comprising:

a regulated power supply circuit that generates a regulated power supply voltage from the input power supply voltage and that maintains the regulated power supply voltage at a substantially constant voltage level relative to the input power supply voltage;

a proportional to absolute temperature ("PTAT") current generating circuit that generates a PTAT current in a first resistor, wherein the PTAT current generating circuit comprises a first diode-connected transistor having a first voltage drop and a second diode-connected transistor having a second voltage drop that are powered by the regulated power supply, and wherein the PTAT current is proportional to a difference between the first and second voltage drops;

a clamping voltage generating circuit that generates a clamping voltage from the input power supply voltage that is greater than the regulated power supply voltage and less than the input power supply voltage and that maintains the clamping voltage at a substantially constant voltage level relative to the input power supply voltage; and an output circuit that comprises a third diode-connected transistor and a second resistor that are powered by the clamping voltage, wherein the output circuit generates the bandgap reference voltage using the PTAT current to produce a voltage across the second resistor proportional to a ratio between the first resistor and the second resistor.

16. The bandgap voltage reference circuit of claim 15 wherein the input power supply voltage ranges from approximately 1.8 volts to approximately 5.5 volts.

17. The bandgap voltage reference circuit of claim 16 wherein the bandgap reference voltage is generated at a substantially stable voltage level throughout the range of the input power supply voltage.

18. The bandgap voltage reference circuit of claim 15 wherein the regulated power supply voltage is approximately 1.2 volts.

19. The bandgap voltage reference circuit of claim 15 wherein the clamping voltage is approximately 3 volts.

20. The bandgap voltage reference circuit of claim 19 wherein the clamping voltage level is substantially stable throughout the range of the input power supply voltage.

21. The bandgap voltage reference circuit of claim 15 further comprising a negative feedback loop that maintains the regulated power supply voltage at a substantially constant voltage level relative to the input power supply voltage, wherein the negative feedback loop maintains the PTAT current proportional to temperature.

* * * * *